United States Patent [19]

Morris

[11] Patent Number: 4,705,614

[45] Date of Patent: Nov. 10, 1987

[54] CELL WITH IMPROVED ELECTROLYTE FLOW DISTRIBUTOR

[75] Inventor: Gregory J. E. Morris, Lake Jackson, Tex.

[73] Assignee: The Dow Chemical Company, Midland, Mich.

[21] Appl. No.: 861,801

[22] Filed: May 12, 1986

[51] Int. Cl.[4] ..... C25B 9/00; C25B 15/08

[52] U.S. Cl. ..... 204/257; 204/258; 204/266; 204/263

[58] Field of Search ..... 204/255–258, 204/263–266, 253–254, 270

[56] References Cited

U.S. PATENT DOCUMENTS

| | | | |
|---|---|---|---|
| 583,513 | 6/1897 | Spilker | 204/258 X |
| 1,272,397 | 7/1918 | Dohmen | 204/256 |
| 3,925,186 | 12/1975 | Giacopelli | 204/270 X |
| 3,930,980 | 6/1976 | De Nora et al. | 204/256 |
| 3,945,908 | 3/1976 | Hempell et al. | 204/270 X |
| 4,244,802 | 1/1981 | Pohto et al. | 204/263 X |
| 4,285,794 | 8/1981 | Bellows et al. | 204/263 X |
| 4,322,281 | 3/1982 | Wright et al. | 204/258 X |
| 4,505,789 | 3/1985 | Ford | 204/270 |

*Primary Examiner*—Donald R. Valentine
*Attorney, Agent, or Firm*—James H. Dickerson, Jr.

[57] ABSTRACT

In a stacked plurality of similar electrolysis cells, each cell having an overhead gas for accumulating gasses produced thereby, the apparatus of the present disclosure includes a shaped transition tube connected to each cell. Inlet liquids and outlet gasses with their respective liquids to be fed and removed through a pair of respective adjacent headers.

13 Claims, 4 Drawing Figures

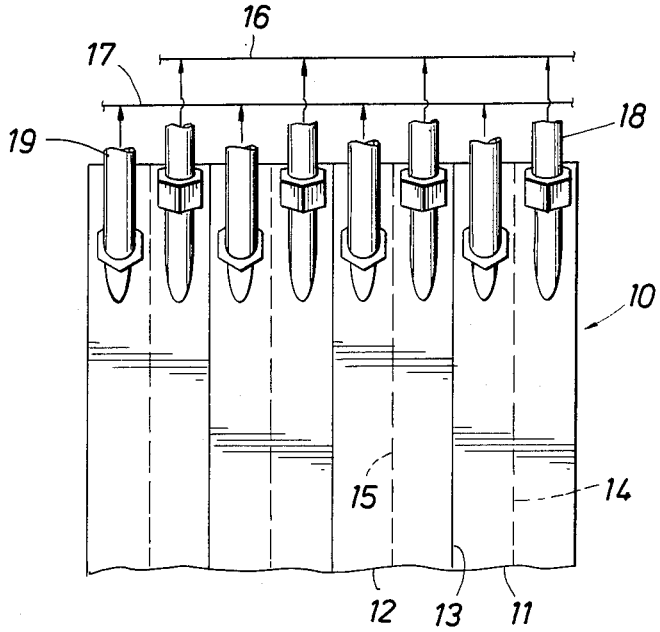
FIG. 1
FIG. 2
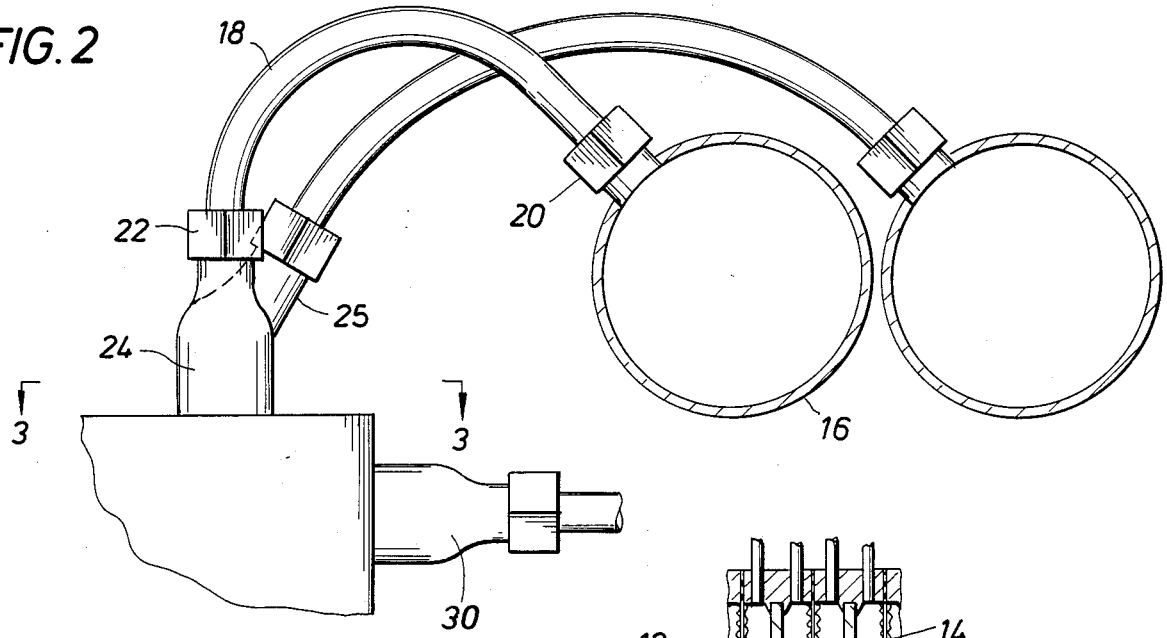
FIG. 3
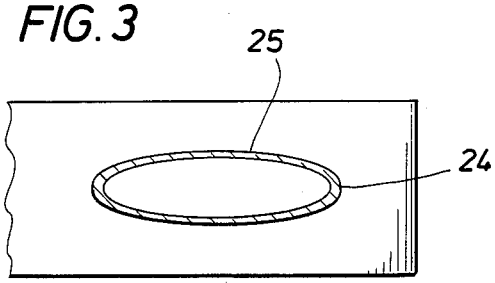
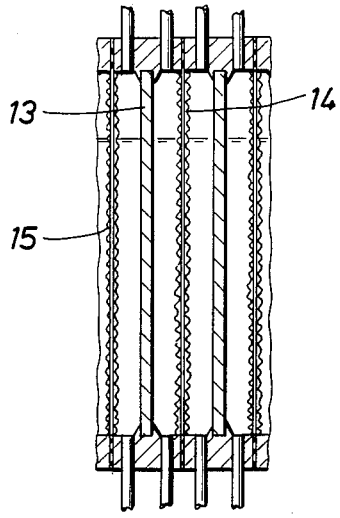
FIG. 4

CELL WITH IMPROVED ELECTROLYTE FLOW DISTRIBUTOR

BACKGROUND OF THE DISCLOSURE

This invention relates to an electrolytic cell and in particular a cell with improved electrolyte flow distributor.

It is well established that various chemicals can be produced in an electrolytic cell containing an anode and a cathode. For example, alkali metal bromates and chlorates, such as sodium chlorate, have been formed electrolytically from a sodium chloride brine in cells without a separator positioned between the anode and cathode. When a separator, such as a liquid permeable asbestos or polytetrafluoroethylene diaphragm or a substantially liquid impervious ion exchange membrane, is used in a cell to electrolyze a sodium chloride brine, the electrolytic products will normally be gaseous chlorine, hydrogen gas and an aqueous solution containing sodium hydroxide.

For a number of years, gaseous chlorine was produced in electrolytic cells with an asbestos diaphragm interposed between finger like anodes and cathodes which were interleaved together. During the past several years, it has become apparent that the use of a substantially liquid impermeable cation exchange membrane may be preferable to the well established diaphragm in instances where a higher purity (for example, a lower sodium chloride content) sodium hydroxide product is desired. It was found to be more convenient to fabricate ion exchange type electrolytic cells from relatively flat or planar type electrolytic cells from relatively flat or planar sheets of ion exchange membrane rather than to interweave the membrane between the anode and cathode in the older finger like or battery leaf type cells having asbestos diaphragms.

The newer, so called flat plate electrolytic cells using a planar sheet of ion exchange membrane have allowed the industry to develop much larger and substantially thinner electrolytic cells than its predecessor electrolytic cell design previously described. The increase in size is relative, namely an increase in size in two dimensions while holding the depth of the structure relatively thin.

The conventional operating mode of large size flat plate electrolytic cells is to provide a direct current causing ionic transfer across the membrane, the current flowing between spaced anode and cathode electrodes. Adjacent cells are separated by a plurality of liquid impervious frames adapted to support the anode on one side and the cathode on the opposite side. In conjunction with the development of relatively thin flat plate electrolytic cells, membranes have also improved. Membranes are now available to the industry that operate at substantially higher current loads, thereby yielding a substantial increase in production. With this substantial increase in production, a problem of providing an increased flow of liquids into and gas and liquid flow out of this type of cell has become a major concern. Typically, these inlet and outlet lines have been fabricated using circular piping designs.

The above features of a flat plate bipolar electrode type, filter press type electrolytic cell unit can also be observed in the following references: U.S. Pat. Nos. 4,364,815; 4,111,779; 4,115,236; 4,017,375; 3,960,698; 3,859,197; 3,752,757; 4,194,670; 3,788,966; 3,884,781; 4,137,144; and 3,960,699.

A review of these patents discloses the above described structural elements in various forms, shapes, and connecting means. It will be recalled that the cells are relatively thin and moreover, a significant portion of the center line of each cell is devoted to structurally supporting the transverse membrane and the spaced electrodes. Typically, the central membrane and the two adjacent electrodes comprise three sheet like members positioned across the cell. The three are coextensive with the length and width of the cell. Since adjacent cells are side by side, a common divider plate or wall between two cells will serve for both. This divider plate further restricts the available space to obtain access to the chambers in adjacent cells. The connective areas are relatively narrow so that access to each cell is somewhat limited.

Because of this limitation on the cell width, it is hard to obtain adequate throughput through a limited diameter flow line. The diameter cannot be increased because the diameter is limited by the width of each half of the cell. The cell is enclosed around the periphery by a surrounding closure member, or top and side peripheral flange. If, for instance, the entire cell is 3 inches thick, the separate sides of the cell are approximately 1 inch thick after suitable allowance for the central support frame between the anode and cathode.

The outlet line diameter cannot become very large because it is limited by the width of the space available to complete a pipe connection to the cell to properly plumb the outlet line.

References having a bearing on the present disclosure include U.S. Pat. Nos. 3,930,980 and also 4,033,848. The first reference (column 6, line 41 and following) describes various outlets also set forth in the several drawings of that disclosure. The shape of the opening into the cell is not made clear in that disclosure but there is a transition piece connected to the cell as better shown in FIGS. 9 and 10 thereof. In the other reference, column 4, line 26 discusses a flattened orifice 26 which evenly disperses fluid input to the electrode. These two disclosures are relatively incomplete in terms of setting forth a suitable structure.

The present apparatus sets forth a construction of a cell gas effluent piping or plumbing system which cooperates with an outboard header to remove gas from the cell. Gas and liquid removal is accomplished with minimum back pressure. Moreover, increased removal enables an adequate flow volume to be delivered from each cell into a collection header for several cells, taking into account that they are assembled closely together.

The present apparatus has the advantage of a structure which handles the gasses and liquids to be discharged in an adequate fashion. More than adequate, the output system operates with a minimum of back pressure to collect the gasses from several adjacent cells. Since there are two types of gasses and two effluents formed, there are duplicate header lines which are deployed for connection to alternating cell chambers.

While the foregoing touches briefly on the disclosed apparatus, the scope is determined by the claims which are affixed below following a discussion of the preferred embodiment.

DETAILED DESCRIPTION OF THE DRAWINGS

So that the manner in whch the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a plan view of a series of electrolytic cells having output gas and liquid headers connected to collect commonly produced gasses and effluents in different headers;

FIG. 2 is an end view of the structure shown in FIG. 1 showing details of construction of a pair of headers and connected header lines for delivery of the gasses and liquids from the electrolytic cells;

FIG. 3 is a sectional view through one of the headers shown in FIG. 2 along the line 3—3 to set forth details of construction of the header; and FIG. 4 is a view through several adjacent cells showing the relative close packing of membranes and divider walls and illustrating the deployment of various conduits and pipes for operation of the several cells.

DETAILED DESCRIPTION OF THE PREFERRED EMBODIMENT

Attention is directed to FIG. 1 of the drawings where the numeral 10 identifies a stack of several identical electrolysis cells. Assume for easy description that the several identical cells are connected serially across a voltage source. Assume further that they are provided with a common feed. One feed is water and the other NaCl and water. By operation in accordance with known chemistry, chlorine and hydrogen gasses are liberated. In addition, caustic having the preferred form of NaOH is formed. These chemicals are obtained in substantial quantities from continuous commercial operation.

The cells are relatively thin, but can be quite tall and long. They are thin in comparison with their other dimensions. One reason to construct the cells thinly is the fact that they take up less floor space, thereby reducing the size of the production plant. This reduces the capital required to build a plant utilizing this technology. These cells are formed of sheet like material. As an example, FIG. 4 shows the two electrodes spaced adjacent to a membrane between the two.

In FIG. 1, several cells are illustrated. The first cell is identified at 11 while the adjacent cell 12 is identically constructed. The two abut a common divider wall at 13. Each of the two cells is internally divided. The cell 11 thus has a membrane located at 14 while the cell 12 has a membrane 15. The membranes are included to show the relative equal division of each cell into two halves, this referring to the anode and cathode compartments. It will be observed that there is a collection header at 16 parallel to a similar collection header 17. The header 16 is connected to the right hand side of each cell by means of a flow line 18. The flow lines 18 are similar in construction and connect in common to remove gas and liquid from the right side of each cell. By contrast, similar header lines 19 connect the opposing sides of the respective cells. The lines 19 are summed at the header 17. Thus, the lines 19 collectively carry away a particular gas and liquid. The gas and liquid are removed from the area of the cells and delivered elsewhere for compression and storage. In the process described above, the two gasses and liquids are hydrogen and chlorine and caustic and brine. It might be alternate gasses and liquids depending on the nature of the electrolytic transfer and reaction which occurs in the cells.

Attention is now directed to FIG. 2 of the drawings which is a side view of the structure shown in FIG. 1. There, an individual feed line 18 is shown. The line 18 connects with the laterally located header 16. The header 16 is of sufficient diameter to handle the flow from several connected lines. It has an attached fitting which is threaded to join with a nut 20, the nut securing one end of the bent header pipe 18. At the opposite end, a similar nut 22 is threaded to the line 18 and affixes that end of the line. The line 18 connects with the upper end of a shaped transition tube 24. The transition tube 24 is circular at the top end to enable connection with the fitting 22. At the lower end, it is oval shaped. In other words, it defines an ellipse at the lower end as better shown in the sectional cut line for FIG. 3. The dimension across the width is identified by the numeral 25. This dimension is relatively narrow. This dimension is limited by the physical dimensions of the cell. Moreover, it is limited by the close spacing of adjacent electrolysis cells, therebeing the usual membrane 14 or 15 and adjacent cell divider wall 13. Thus, a significant portion of the cell wall edge can not be used to access the cell interior. It is desirable, therefore, to limit the width of the transition tube, this limitation thereby relating to the oval or elliptical shape shown in the drawings.

The several cells each have two such headers. Recall that two are required because two different gasses and liquids are formed. Recall further that the gasses and liquids that are formed are quite reactive and have a high level of chemical activity. For this reason, it is highly desirable to fully ventilate the head space in each cell to remove as much of the gas as possible. Once removed, the gas and liquid are delivered to the header as shown in FIG. 2 for transfer elsewhere for compression, storage, or other use.

As shown in FIG. 4 of the drawings, the several cells that are adjacent to one another are stacked in such close proximity that access to the respective cell portions is limited. In this deployment, each particular cell must include a surrounding gasket cooperative with the membrane to prevent electrical shorting of the two halves. Recall that one side is provided with a positive voltage and that the opposing side is provided with a negative voltage. Spacing of the two electrodes is in part controlled by the voltage applied across the cell, and therefore, the periphery around each cell is limited by electrical insulating gaskets. This limited access must take into account division of each cell into two facing components separated by an electrical insulator gasket and seal cooperative with the membrane and electrodes.

In general terms, the transition tube 24 shown in FIG. 2 provides a marked increase in throughput into the header 18. Behind it, there is a similar and related header having a similar transition tube 25.

In this arrangement, a substantial volumetric throughput from each cell is then permitted. This arrangement cuts down flow restriction. In fact, it reduces restriction to flow to thereby increase the throughput of the cell. Back pressure maintained in this region is highly undesirable. Moreover, the back pressure reduction is accomplished for both sides, namely, the gaseous discharges from both sides of each cell.

While the foregoing describes the preferred embodiment, the scope is determined by the claims which follow.

What is claimed is:

1. For use in an electrolytic cell having a central membrane dividing the cell into cathode and anode regions wherein cathode and anode electrodes are placed on opposite sides of the membrane, a cell construction comprising:

(a) a catholyte flow means opening from the cathode side of the cell;

(b) an anolyte flow means opening from the anode side of the cell;

(c) wherein said flow means are respectively located in operative communication with the cathode and anode compartments within the cell;

(d) a top and walls forming the cell and defining a relatively narrow dimension across the top perpendicular to the membrane;

(e) elliptical nozzle means connected on both sides of the membrane to aid in flow of catholyte and anolyte gases and effluents of the cell, said nozzle means aiding cell operation by reducing back pressure during liquid and gas removal as electric current flows between the cathode and anode across the membrane;

(f) wherein said nozzle means includes a fitting external to said cell, said fitting connected serially with said nozzle means;

(g) an externally located gas collection header means adjacent to said cell located such that header means does not pass over the top of said cell; and (h) curving lateral lines extending from said header and effluent removal for operation of said cell.

2. The apparatus of claim 1 wherein said nozzle means comprises an elliptical nozzle having a circular neck thereon.

3. The apparatus of claim 1 wherein said nozzle means comprises an elliptical nozzle opening into the top of said cell.

4. The apparatus of claim 1 including a transition tube comprising said nozzle means.

5. The apparatus of claim 4 wherein said transition tube includes an elliptical opening at the lower end of the tube faired into a round pipe having threads thereon.

6. The apparatus of claim 5 wherein said round pipe is axially aligned with said transition tube.

7. The apparatus of claim 5 wherein said round pipe is axially misaligned with said transition tube.

8. For use in an electrolytic cell having a central membrane dividing the cell into cathode and anode regions wherein cathode and anode electrodes are placed on opposite sides of the membrane, a cell construction comprising:

(a) a catholyte flow means opening from the cathode side of the cell;

(b) an anolyte flow means opening from the anode side of the cell;

(c) wherein said flow means are respectively located in operative communication with the cathode and anode compartments of within the cell;

(d) a top and walls forming the cell and defining a relatively narrow dimension across the top perpendicular to the membrane;

(e) elliptical nozzle means connected on both sides of the membrane to aid in flow of catholyte and anolyte gases and effluents of the cell, said nozzle means aiding cell operation by reducing back pressure during liquid and gas removal as electric current flows between the cathode and anode across the membrane;

(f) a transition tube comprising said nozzle means;

(g) an externally located gas collection header means adjacent to said cell located such that said header means does not pass over the top of said cell; and (h) curving lateral lines extending from said header means for connection to said nozzle means fitting to enable cell gas and effluent removal for operation of said cell.

9. The apparatus of claim 8 wherein said nozzle means comprises an elliptical nozzle having a circular neck thereon.

10. The apparatus of claim 8 wherein said nozzle means comprises an elliptical nozzle opening into walls defining said cell, and is connected to an outlet line.

11. The apparatus of claim 8 wherein said transition tube includes an elliptical opening at the lower end of the tube faired into a round pipe having threads thereon.

12. The apparatus of claim 11 wherein said round pipe is axially aligned with said transition tube.

13. The apparatus of claim 11 wherein said round pipe is axially misaligned with said transition tube.

* * * * *